US007192499B1

(12) United States Patent
Talley, Jr.

(10) Patent No.: US 7,192,499 B1
(45) Date of Patent: Mar. 20, 2007

(54) NONWOVEN FABRIC WITH CHARACTERISTICS SIMILAR TO WOVEN AND KNITTED FABRICS

(75) Inventor: Arthur Talley, Jr., Melbourne, FL (US)

(73) Assignee: Hills, Inc., West Melbourne, FL (US)

( * ) Notice: Subject to any disclaimer, the term of this patent is extended or adjusted under 35 U.S.C. 154(b) by 145 days.

(21) Appl. No.: 10/159,284

(22) Filed: Jun. 3, 2002

Related U.S. Application Data

(60) Provisional application No. 60/294,636, filed on Jun. 1, 2001.

(51) Int. Cl.
*B32B 37/00* (2006.01)

(52) U.S. Cl. ..... 156/84; 156/167; 156/168; 156/180; 156/290; 156/296; 264/172.11; 264/172.17; 264/172.19; 19/299

(58) Field of Classification Search ..... 156/84–85, 156/166–168, 180, 290–291, 296; 442/361–365; 428/198, 373–374, 913; 264/172.11, 172.13–172.19, 264/173.1, 210.8, 211.15, 211.17; 19/296, 19/299
See application file for complete search history.

(56) References Cited

U.S. PATENT DOCUMENTS 4,361,609 A * 11/1982 Gerlach et al. ..... 428/90
4,369,156 A * 1/1983 Mathes et al. ..... 264/147
4,663,221 A * 5/1987 Makimura et al. ..... 442/200
5,525,706 A 6/1996 Gruber et al.
5,759,926 A 6/1998 Pike et al.
5,958,322 A 9/1999 Thompson et al.
6,146,580 A 11/2000 Bontaites, Jr.
6,371,749 B2 4/2002 Thompson et al.
6,620,485 B1 * 9/2003 Benson et al. ..... 428/156

FOREIGN PATENT DOCUMENTS

WO WO 99/48668 * 9/1999
WO WO 00/20178 * 4/2000

* cited by examiner

*Primary Examiner*—Jessica Rossi
(74) *Attorney, Agent, or Firm*—Edell, Shapiro & Finnan, LLC

(57) ABSTRACT

A nonwoven fabric having characteristics resembling woven and knitted fabrics is produced by extruding a plurality of plural component fibers, where each fiber includes first and second polymer components with the first polymer component having a degree of shrinkage when subjected to heat. A nonwoven web of the extruded fibers is formed on a web forming surface and bonded. The bonded web of fibers are post-bond treated to shrink at least the first polymer component and separate at least a portion of the second polymer component from the first polymer component utilizing any combination of heat, mechanical agitation and dissolving of fiber components. The resultant nonwoven fabric has a texture, drape and feel of woven and knitted fabrics.

10 Claims, 1 Drawing Sheet

NONWOVEN FABRIC WITH CHARACTERISTICS SIMILAR TO WOVEN AND KNITTED FABRICS

CROSS REFERENCE TO RELATED APPLICATIONS

This application claims priority from U.S. Provisional Patent Application Ser. No. 60/294,636, entitled "Method Of Making a Spunbond Fabric With Fabric Characteristics Approaching Woven And Knitted Characteristics", filed Jun. 1, 2001. The disclosure of this provisional patent application is incorporated herein by reference in its entirety.

BACKGROUND OF THE INVENTION

1. Field of the Invention

The present invention relates to the production of a nonwoven web of fabric that has characteristics similar to woven and knitted fabrics.

2. Description of the Related Art

It has long been desirable to create a nonwoven web of fabric that looks and feels like woven cloth. However, attempts at achieving such a fabric have been unsuccessful. For example, in spunbond or meltblown processes, extruded fibers are typically laid on a web forming surface, such as a forming table or screen belt, to form a web which is then bonded utilizing calender rolls or some similar bonding device to form the nonwoven fabric. The bonding of the web results in bond points between fibers that are too visible to the naked eye up to distances of about three feet from the fabric. The visibility of these bond points can be aesthetically undesirable depending upon the type of textile article to be produced utilizing this fabric. In addition, non-uniform fiber distribution in the formation of the fabric and the distance between bond points results in a fabric with rather random porosity and with visible holes in the fabric, which limits the strength and durability of the fabric.

Other problems associated with forming nonwoven webs of fabric can occur when using heat shrinkable polymer fibers such as polyester fibers. In particular, it is well known that spunbond polyester fibers tend to shrink, particularly when spun at spinning speeds below about 3500 meters per minute (MPM), by 50% or more during any post-spun heat treating process. Polyester fibers exhibit similar heat shrinking characteristics when produced utilizing a meltblown or other fiber forming process. The reason for this is that the polyester fibers are relatively amorphous after extrusion, but achieve a higher degree of crystallinity when subjected to heat which causes shrinkage of the fibers. When heat bonding such polyester (or other similar heat shrinkable polymer) fibers together, the shrinking fibers yield a resultant nonwoven fabric that is stiff and board-like. Manufacturers typically go to great lengths to eliminate the high shrinkage of polyester during nonwoven fabric formation, employing such techniques as adjusting calender roll temperatures, utilizing complex equipment to achieve higher spinning speeds during fiber extrusion, and applying heat at varying stages to the extruded fibers.

Thus, it is desirable to obtain a nonwoven web of fabric material that has the look and feel of woven and knitted fabrics by eliminating visible bond points and reducing or controlling porosity within the bonded web without imparting undesirable stiffness to the fabric material.

SUMMARY OF THE INVENTION

Therefore, in light of the above, and for other reasons that become apparent when the invention is fully described, an object of the present invention is to produce a nonwoven web of fabric that is similar in texture, drape and feel to woven and knitted fabrics.

It is another object of the present invention to obtain a nonwoven web of fabric that has bond points that are not too visible to the naked eye.

It is a further object of the present invention to produce a nonwoven web of fabric that has a reduced porosity and enhanced strength in comparison to conventional nonwoven fabrics.

It is still another object of the present invention to obtain a nonwoven web of fabric similar in texture, drape and feel to woven and knitted fabrics utilizing heat shrinkable polymer fibers such as polyester.

The aforesaid objects are achieved individually and in combination, and it is not intended that the present invention be construed as requiring two or more of the objects to be combined unless expressly required by the claims attached hereto.

Nonwoven fabrics are produced in accordance with the present invention by extruding plural component fibers containing at least two polymer components that are separable from each other upon bonding and/or post-bond treatment of the fibers, where at least a first polymer component is relatively amorphous or otherwise heat shrinkable after extrusion. Optionally, the fibers also include at least a second polymer component that is either relatively nonshrinkable or shrinks to a lesser degree in comparison to the first polymer component when subjected to heat after extrusion.

The fibers are laid down upon a forming surface to form a nonwoven web, and the web is bonded. In an exemplary embodiment, the nonwoven web is bonded with calender rolls. The first, shrinkable polymer component in each fiber is heat shrunk during and/or after bonding of the web. The separation of fiber components occurs during bonding and/or post-bond treatment by splitting of fiber components and/or by dissolving at least one fiber component in the plural component fibers so as to yield a fabric including separate fiber segments. The resultant fabric includes bonding points between fibers that are miniaturized and drawn toward one another as a result of the shrinkage by polymer components, and the areas of high porosity are minimized by the shrinkage of the fabric and the improved fabric coverage inherent with the fiber segments resulting from the splitting and/or dissolving process. The resultant fabric further exhibits a suitable texture, drape and feel that resembles woven and knitted fabrics. In addition, a particular cloth-like appearance for the fabric can be achieved by forming a pattern of bonds in the nonwoven web that simulates the look and/or feel of cloth.

The above and still further objects, features and advantages of the present invention will become apparent upon consideration of the following detailed description of specific embodiments thereof.

DESCRIPTION OF THE PREFERRED EMBODIMENTS

Figure 1:
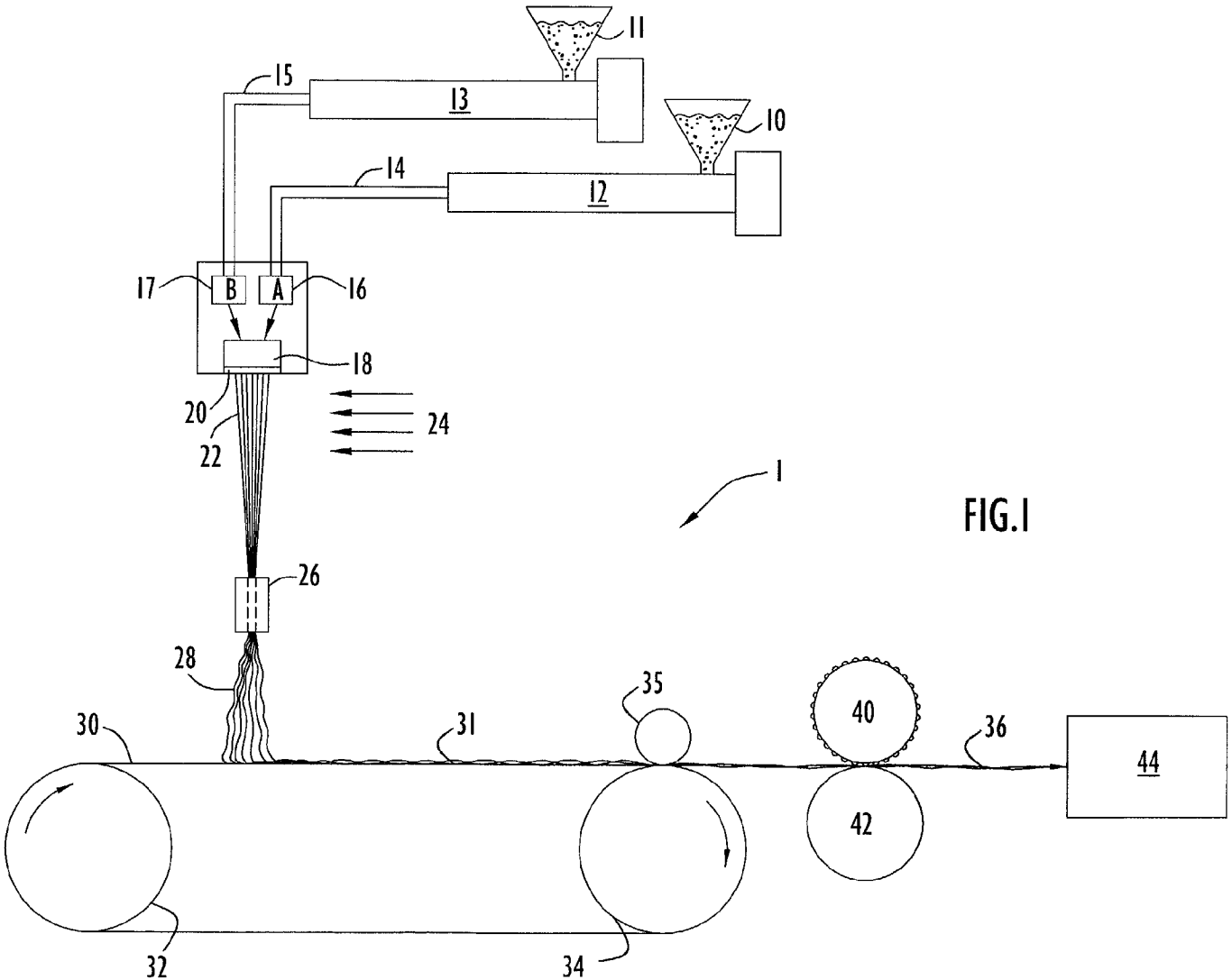
FIG. 1 is a diagrammatic view of a spunbond system for forming nonwoven webs of fibers in accordance with an exemplary embodiment of the present invention.

A nonwoven fabric that has characteristics resembling woven and knitted fabrics is produced, in accordance with the present invention, by extruding plural component fibers and forming a web with such fibers. The term "plural component", as used herein, refers to a fiber having two or more components forming distinct portions of the fiber. At least two of the components of the plural component fiber are separable from each other during bonding and/or during post-bond treatment of the web of fibers. The terms "post-bond" and "post-bonding", as used herein in relation to nonwoven fabric production, refer to any processing step or steps that occur downstream or after bonding of the nonwoven web. While post-bond treatment, as described below, is preferred to achieve a desired degree of separation between fiber components, it is noted that some degree of separation of fiber components may also occur prior to and/or during bonding of the fibers.

The different components of the plural component fiber can form a variety of fiber configurations including, without limitation, side-by-side, sheath/core, segmented pie, ribbon-shaped or striped (i.e., alternating components arranged linearly), and island-in-the-sea configurations. Additionally, the cross-sectional fiber configurations may include any suitable symmetrical or assymmetrical geometries including, without limitation, round or circular, multi-lobal, tetragonal, key-hole shaped and star-shaped geometries.

Separation of fiber components after bonding of the web preferably occurs by splitting and/or dissolving of at least two of the fiber components to form fiber segments. The term "splittable", as used herein in relation to fibers, refers to at least two fiber components of the plural component fiber that are detachable from each other along at least a portion of the longitudinal extent of the components. The term "dissolvable", as used herein in relation to fibers, refers to at least one polymer component in the plural component fiber that can be dissolved and thus removed from the fiber when the fiber is treated with a suitable solvent. The term "fiber segment", as used herein, refers to a portion of a fiber remaining in the web after a desired separation of fiber components has been achieved. A fiber segment may include one or more fiber components of the plural component fiber that have not been separated, and plural component fibers may be separated into any one or more fiber segments to form a resultant fabric with desired characteristics in accordance with the present invention. Fiber segments formed as a result of certain post-bonding treatments described below are preferably microfibers have a fineness of less than about 0.25 denier.

At least one component of the plural component fiber includes a first polymer that is relatively amorphous or otherwise heat shrinkable upon extrusion of the fiber in a spunbond, meltblown or any other related process and exhibits a high degree of shrinkage when subjected to heat. Exemplary first polymer components that exhibit such shrinkage characteristics include, without limitation, polyesters such as polyethylene terephthalate (PET), polyethylene naphthalate (PEN), polytrimethylene terephthalate (PTT) and polybutylene terephthalate (PBT); polyacrylamides; polyurethanes; polylactic acid (PLA); polyamides such as Nylon 6, Nylon 6,6 and Nylon 6,10; and any combinations thereof (e.g., slow crystallizing copolyesters of PET based on comonomers such as isophthalic acid and cyclohexane dimethanol).

Optionally, at least another component of the plural component fiber may include a second polymer that has some degree of shrinkage when subjected to heat. For example, the second polymer component of the plural component fiber may be a polymer that achieves a sufficient degree of crystallinity after fiber extrusion such that the second polymer component experiences substantially no shrinkage when the fiber is subjected to heat (e.g., during calender bonding). Exemplary second polymer components that exhibit little or no shrinkage in the extruded fiber when subjected to heat include, without limitation, polyolefins such as polyethylene and polypropylene; ethylene vinyl alcohol (EVOH); and polyvinyl alcohol (PVA). Alternatively, the second polymer component may include a polymer that undergoes shrinkage when exposed to heat that may be less or substantially the same degree in comparison to shrinkage of the first polymer component in the plural component fiber. For example, when utilizing PET in a first polymer component of a plural component fiber, second polymer components that may be included in the fiber that are shrinkable include, without limitation, Nylon 6, Nylon 66, polyurethane, PTT, or any of the other previously noted first polymer components.

When utilizing a spunbond process to manufacture the plural component fibers, spinning speed is particularly important in that it determines whether and how much certain polymer components will shrink. For example, with PET, if the spinning speed is above about 4000 to 4500 MPM, little or no shrinkage will result. As spinning speeds are reduced below about 3500 MPM, greater shrinkage results, with up to thirty percent shrinkage at spinning speeds of 2000 MPM. Since such shrinkage has been heretofore undesirable, most conventional spunbond processes involving PET require high spinning speeds that avoid shrinkage. However, in accordance with the present invention, a low spinning speed may be desirable to effect a desired degree of shrinkage of at least the first polymer component during or after bonding of the nonwoven web as described below.

The plural component fibers including at least a first polymer component as described above are separable (e.g., by splitting and/or dissolving) after being heat bonded (e.g., by calender rolls). Depending upon the amount heat applied during the heat bonding step, crystallization of at least the first polymer component may occur to a sufficient degree upon bonding of the web such that the first polymer component shrinks. Some splitting of fiber components may also occur at web bonding if a sufficient variance in the degree of shrinkage exists between those fiber components.

However, to ensure a desirable degree of shrinkage of at least the first polymer component, a sufficient degree of separation between fiber components, and to yield a resultant fabric with desired characteristics resembling woven and knitted fabrics, it is preferable to provide post-bond treatment to the nonwoven web including heating and/or mechanical agitation as described below. The post-bond treatment may include heating of the web utilizing any suitable heat source to heat the fibers to a suitable temperature and achieve a desired degree of crystallization and corresponding shrinkage of at least the first polymer component in the fibers. Exemplary heat sources include, without limitation, ovens, hot air knives, steam or other heated gases, heated water (or other heated fluid mediums) and radiation (e.g., X-ray or infrared). For example, when utilizing PET as the first polymer component, post-bond heating of at least about 120° C. is preferred to achieve a desired degree of shrinkage of the PET within a reasonable amount of heating time. Preferably, the post-bond heat treatment is implemented under conditions where the web is not constrained so as to maximize shrinkage of the fabric.

When utilizing splittable components in the plural component fibers of the web, post-bond heating to induce shrinkage of the first polymer component in the plural component fiber may result in sufficient splitting of selected fiber components. Alternatively, additional splitting and/or dissolving techniques may be employed to achieve further separation of selected fiber components after post-bond heating of the web. For example, techniques such as hydrosplitting with water jets or needle punching may be utilized to effect a desired degree of separation between fiber components. In the case of a plural component fiber including a dissolvable component, the web is post-bond treated to dissolve and wash away the dissolvable component to achieve a desired separation between fiber components and a resultant fabric with desired characteristics.

The bonded web may also be treated utilizing mechanical agitation techniques, alone or in combination with any of the previously described post-bond treatment techniques. Exemplary mechanical agitation techniques include, without limitation, scouring, wrenching, dying, and tumbling (e.g., in a tumble washer and/or dryer), or any combination of these conventional techniques or any other suitable techniques. The fabric can undergo multi-axis stretching to cause at least one of the fibers to become elongated. Stretching in the machine direction and cross direction can be achieved using a tinner frame to set width and openness. Another exemplary mechanical agitation technique for achieving a desired separation of fiber components involves scouring and soaking of the web of fibers in a heated fluid bath (e.g., water) tumbling the fabric (e.g., in a fabric washer), followed by drying and tumbling the soaked fabric in a heated gas (e.g., in a fabric dryer).

It is noted that any combination of the previously described post-bond treatment techniques described above may be employed inline during formation of the fibers and the nonwoven webs and/or utilizing separate systems. For example, when utilizing an industrial fabric washer and/or fabric dryer, a combined heat treatment and mechanical agitation of the bonded nonwoven web would preferably be in a conventional batch type process rather than a continuous process, where a selected amount of nonwoven web of fabric would be treated within the washer and/or dryer for a selected period of time.

The shrinkage of at least the first polymer component after bonding miniaturizes bond points, as well as distances between the bond points, in the nonwoven web by up to about thirty to forty percent in comparison to typical spunbond webs, which enhances the strength and reduces porosity of the resultant fabric. At the same time, splitting or dissolving of one or more other fiber components keeps the resultant fabric flexible and prevents the resultant fabric from becoming stiff and board-like. Whereas typical nonwoven fabrics, in particular spunbond fabrics, have bond points and pin holes that are visible to the naked eye, nonwoven fabric may be produced in accordance with the present invention to be cloth-like in appearance, texture, drape and feel with no noticeable bond points and/or pin holes. In addition, a particular cloth-like appearance for the fabric can be achieved by designing a calender or other suitable bonding device to form a pattern of bonds that simulates the look and/or feel of cloth after appropriate heat treatment of the fabric.

The separation of components in the plural component fibers and the formation of fiber segments maintains a certain softness and cloth-like texture for the fabric, in contrast to the stiff and board-like fabric material that is typically formed with nonwoven webs formed of fibers having a single heat shrinkable polymer component such as PET. When utilizing a second fiber component as described above, the degree of shrinkage of the second fiber component can also affect the bulk of the resultant fabric. For example, if the second fiber component undergoes very little shrinkage upon heat bonding and/or post-bond heat treatment and thus remains relatively the same length while the first fiber component undergoes significant shrinkage, the resultant fabric may have significant bulk as a result of the second fiber components spatially extending from the shrunken first fiber components. In particular, the low or relatively no shrinkage second fiber components form short loops of fiber segments that spatially extend between the bond points of shrunken first component fiber segments. The look, feel and texture of the fabric may also be varied depending upon the specific fiber components utilized to form the fabric, their varying degrees of shrinkage and separability, and whether any fiber components are dissolvable. Thus, any combination of the previously described factors may be implemented to vary characteristics and styles of resultant fabrics.

An exemplary system for producing nonwoven fabrics having characteristics similar to woven and knitted fabrics is illustrated in FIG. 1. While the process depicted in FIG. 1 is a spunbond process, it is noted that webs of fibers may alternatively be formed utilizing a melt blown or any other suitable fiber forming process. Spunbond system 1 includes a first hopper 10 into which pellets of a first polymer component A are placed. The polymer is fed from hopper 10 to screw extruder 12, where the polymer is melted. The molten polymer flows through heated pipe 14 into metering pump 16 and spin pack 18. A second hopper 11 feeds a second polymer component B into a screw extruder 13, which melts the polymer. The molten polymer flows through heated pipe 15 and into a metering pump 17 and spin pack 18. Polymer components A and B are selected, e.g., from the groups of first and second polymer component polymers noted above, such that component A has a much greater degree of shrinkage in comparison to component B when fibers produced with these components are subjected to a suitable temperature for a sufficient period to crystallize component A.

Spin pack 18 includes a spinneret 20 with orifices through which fibers 22 are extruded. The design of the spin pack is configured to accommodate multiple polymer components for producing any of the previously noted plural component fibers having any desired cross-sectional geometries. An exemplary embodiment of a suitable spin pack that may be utilized with the system is described in U.S. Pat. No. 5,162,074, the disclosure of which is incorporated herein by reference in its entirety.

The extruded fibers 22 are quenched with a quenching medium 24 (e.g., air), and are subsequently directed into a drawing unit 26, depicted as an aspirator in FIG. 1, to increase the fiber velocity and to attenuate the fibers. Alternatively, it is noted that godet rolls or any other suitable drawing unit may be utilized to attenuate the fibers. The spinning speed of the extruded fibers may be selectively controlled by controlling operating parameters of the metering pump, the drawing unit and flow of polymer fluid through the spin pack. Thus, a suitable low spinning speed (e.g., lower than about 3500 MPM) may be easily maintained during system operation.

Upon exiting the drawing unit 26, the attenuated fibers 28 are laid down upon a continuous screen belt 30 supported and driven by rolls 32 and 34. The fibers form a web 31 on the screen belt, and are then conveyed through a compaction roll 35 and fed to a nib at calender rolls 40 and 42. Alternatively, it is noted that any suitable web forming surface (e.g., a forming table, drum, roll or any other collection device) may be provided to receive the extruded fibers so as to form a nonwoven web.

Calender rolls 40 and 42 are suitably contoured to form bonding points in a selected pattern or arrangement on the web of fibers 36 passing through the calenders. Each calender roll 40, 42 may be further maintained at a suitable temperature to heat the fibers during bonding so as to promote crystallization of component A within the fibers and achieve a certain degree of shrinkage of component A. After bonding, the web of fibers 36 is post-bond treated in accordance with any combination of the heating and/or mechanical agitation techniques described above to achieve the desired degree of fabric shrinkage and fiber component separation. The post-bond treatment is shown schematically as box 44 in FIG. 1. For example, box 44 may include a heater to shrink polymer component A to a suitable degree and induce a certain degree of splitting between components A and B thus forming fiber segments, as well as an industrial washer to receive selected portions of web 36 after heating and mechanically agitate such portions to achieve resultant fabrics with desired characteristics.

The present invention is not limited to the particular system and process described above. Rather, the system may be modified in any suitable manner to achieve a bonded web of plural component fibers with at least one heat shrinkable polymer component and at least one splittable and/or dissolvable polymer component so as to form a nonwoven fabric with characteristics resembling woven and knitted fabrics.

The nonwoven web may be produced utilizing a spunbond, meltblown or any other suitable fiber extrusion system. The plural component fibers utilized to form the nonwoven web may include any suitable number of polymer components, where at least one polymer component has sufficient heat shrinkage characteristics to cause the resultant fabric to shrink upon heating and each fiber includes at least one splittable and/or dissolvable component. Any suitable post-bond process may be applied to the bonded web of fibers to effect a desired degree of shrinkage and/or separation (by splitting or dissolving) of at least one polymer component within the fiber so as to achieve one or more desired fabric characteristics.

Having described preferred embodiments of new and improved systems and methods for producing nonwoven fabrics with characteristics similar to woven and knitted fabrics, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of forming a spunbond nonwoven fabric, the method comprising:

(a) extruding a plurality of plural component fibers, the extruded fibers including a first polymer component and a second polymer component, wherein the first polymer component has a degree of shrinkage when subjected to heat;

(b) laying the extruded fibers onto a web forming surface to form a nonwoven web of fibers;

(c) calender bonding the nonwoven web of fibers so as to form bond points between the fibers;

(d) heating the bonded web to a selected temperature to shrink the first polymer component in the bonded web to decrease bond point size and a spatial dimension between bond points; and (e) separating at least a portion of the second polymer component from the first polymer component in the bonded web of fibers, wherein the separating includes dissolving at least a portion of the second polymer component from the bonded web.

2. The method of claim 1, wherein the first polymer component comprises polyester.

3. The method of claim 1, wherein the extruding of a plurality of plural component fibers includes spinning the fibers in a spunbond system at a spinning speed below about 3500 MPM.

4. The method of claim 1, wherein the separating at least a portion of the second polymer component from the first polymer component includes subjecting the bonded web of fibers to mechanical agitation.

5. The method of claim 1, wherein the separating at least a portion of the second polymer component from the first polymer component includes splitting at least a portion of the second polymer component from the first polymer component.

6. The method of claim 1, wherein the separating at least a portion of the second polymer component from the first polymer component is at least partially achieved during the heating of the bonded web to a selected temperature.

7. The method of claim 6, wherein the second polymer component has a degree of shrinkage when subjected to heat that is not greater than the first polymer component, and the separating of at least a portion of the second polymer component from the first polymer component includes splitting second polymer component segments from first polymer segments upon shrinkage of the first polymer component such that at least a portion of the second polymer component segments spatially extend from the first polymer component segments.

8. The method of claim 6, wherein the heating the bonded web to a selected temperature and the separating of at least a portion of the second polymer component from the first polymer component include heating the bonded web of fibers in a heated gas while subjecting the bonded web of fibers to mechanical agitation.

9. The method of claim 6, wherein the heating the bonded web to a selected temperature and the separating of at least a portion of the second polymer component from the first polymer component include soaking the bonded web of fibers in heated liquid while subjecting the bonded web of fibers to mechanical agitation.

10. The method of claim 9, further comprising:

(f) drying the soaked web of fibers in a heated gas while subjecting the soaked web of fibers to mechanical agitation.

* * * * *